US008157655B2

(12) United States Patent
Meyerhofer et al.

(10) Patent No.: US 8,157,655 B2
(45) Date of Patent: Apr. 17, 2012

(54) SECURED GAMING TABLE DEVICE

(75) Inventors: Eric James Meyerhofer, Pasadena, CA (US); Robert Denham, Reading (GB)

(73) Assignee: Futurelogic, Inc., Glendale, CA (US)

( * ) Notice: Subject to any disclaimer, the term of this patent is extended or adjusted under 35 U.S.C. 154(b) by 690 days.

(21) Appl. No.: 12/267,511

(22) Filed: Nov. 7, 2008

(65) Prior Publication Data

US 2009/0239656 A1 Sep. 24, 2009

Related U.S. Application Data

(60) Provisional application No. 60/986,245, filed on Nov. 7, 2007, provisional application No. 60/987,116, filed on Nov. 12, 2007.

(51) Int. Cl.
*A63F 9/24* (2006.01)

(52) U.S. Cl. ..... 463/46; 463/13

(58) Field of Classification Search ..... 463/13, 463/46

See application file for complete search history.

(56) References Cited

U.S. PATENT DOCUMENTS

2003/0228901 A1* 12/2003 Walker et al. ..... 463/25
2006/0068869 A1* 3/2006 White et al. ..... 463/13

* cited by examiner

*Primary Examiner* — Omkar Deodhar

(57) ABSTRACT

A secured gaming table device that uses TITO and RFID to use and exchange vouchers, winnings from slot machines, promotions, and coupons; provide cashless payout from a gaming table; provide transaction receipts; link gaming tables; and connect and use systems in use, such as the TITO System and Player Tracking System, for credit transfer to and from game vouchers, player tracking cards, promotional coupons, cash, RFID chips, and non-RFID chips, among others, thereby expanding the use of credit transfer to include gaming tables. The secured gaming table device includes a gaming printer, barcode reader or scanner, bill validator, interface, and keypad, among others; and connects to host systems for the issuance and redemption of vouchers and/or promotional coupons at a gaming table.

18 Claims, 9 Drawing Sheets

SECURED GAMING TABLE DEVICE

CROSS-REFERENCE TO RELATED APPLICATION(S)

The present application claims the benefit of U.S. Provisional Patent Application No. 60/986,245 filed Nov. 7, 2007, and U.S. Provisional Patent Application No. 60/987,116 filed Nov. 12, 2007, and is related to PCT Application PCT/US08/56752 entitled "METHODS AND APPARATUS FOR CASHLESS GAMING CREDIT TRANSFER", filed Mar. 12, 2008, published as WO2008112832 which claims the benefit of U.S. Provisional Patent Application No. 60/894,427, filed Mar. 12, 2007, the contents of each of which are hereby incorporated by reference as if fully stated herein.

BACKGROUND OF THE INVENTION

1. Field of the Invention

This invention relates to gaming and casinos, more specifically to a secured gaming table device that uses ticket-in and ticket-out and RFID technology to allow gaming establishments to use and exchange game vouchers, winnings from slot machines, promotions and promotional coupons, to provide cashless gaming at gaming tables, to provide transaction receipts and to link gaming tables and connect and use systems in use to expand the use of credit transfer within a gaming establishment and or associated gaming establishments and their slot machines, change machines, and cashier cages to include gaming tables.

2. Background

The gaming machine manufacturing industry provides a variety of gaming machines for the amusement of gaming machine players. An exemplary gaming machine is a slot machine. A slot machine is an electro-mechanical game wherein chance or the skill of a player determines the outcome of the game. Slot machines are usually found in casinos or other more informal gaming establishments.

Gaming machine manufacturers have introduced cashless enabled games such as a slot machine to the market and these have begun to find wide acceptance in the gaming industry. Cashless enabled games are so named because they can conduct financial exchanges using a mixture of traditional currencies and vouchers. Typically, a cashless enabled game has a gaming printer to produce vouchers and a voucher reader that supports automatic reading of vouchers. To coordinate the activities of multiple cashless enabled games, one or more cashless enabled games can be electronically coupled to a cashless enabled game system that controls the cashless operations of a cashless enabled game.

Over the last several years, cashless enabled games have found an increasing acceptance and use in the gaming industry with both the players, who enjoy the speed of play and ease of transporting their winnings around the casino, and the casinos who have realized significant labor savings in the form of reduced coin hopper reloads in the games, and an increase in revenue due to speed of play. Practical field experience with the application has illustrated that there are areas for improvement in current printer designs and implementation within the game and gaming establishments.

SUMMARY OF THE INVENTION

The present invention identifies a secured gaming table device that uses ticket-in and ticket-out (herein "TITO") and RFID technology to allow gaming establishments to use and exchange game vouchers, winnings from slot machines, promotions, and promotional coupons, to provide cashless payout from a gaming table, to provide transaction receipts, and to link gaming tables and connect and use systems in use, such as the TITO System and Player Tracking System (herein, "PTS"), for credit transfer to and from game vouchers, player tracking cards, promotional coupons, cash, RFID chips, and non-RFID chips, among others, thereby expanding the use of credit transfer within a gaming establishment and or associated gaming establishments and their slot machines, change machines, and cashier cages to include gaming tables. The secured gaming table device includes a gaming printer, barcode reader or scanner, bill validator, user interface, and keypad, among others; and connects to one or more host systems for the issuance and redemption of game vouchers and/or promotional coupons at a gaming table.

In one aspect of the invention, a secured gaming table device includes one or more gaming tables such as a poker table, each table connected to a secured gaming table device having a gaming printer, barcode reader or scanner, bill validator, user interface, one or more controllers, an interface to one or more host systems, keypad, card reader/writer, RFID sensing and/or reading device, and an entry point, among others, wherein any or all components are internal or external to the secured gaming table device.

In another aspect of the invention, a secured gaming table device includes a gaming printer that generates game vouchers, promotions, promotional coupons and/or transaction receipts.

In another aspect of the invention, a gaming printer sends and receives signaling to and from one or more host systems to generate a game voucher, promotional coupon, and/or a transaction receipt.

In another aspect of the invention, a gaming printer sends and receives signaling to and from one or more host systems, the signaling including the completion of a print job such as a game voucher or a promotional coupon, and printer status such as paper low, among others.

In another aspect of the invention, a gaming printer, upon receiving a cash-out signal, generates a game voucher and/or one or more promotional coupons, the cash-out data being transmitted to one or more host systems.

In another aspect of the invention, a secured gaming table device includes a barcode reader or scanner to scan the barcode and/or other indicia or data of each game voucher and/or promotional coupon inserted for the validation and/or verification of such.

In another aspect of the invention, a barcode reader or scanner, upon receiving a cash-in or coupon-in signal, scans the barcode of a game voucher and/or one or more promotional coupons, the barcode data being transmitted to one or more host systems for validation and verification.

In another aspect of the invention, a barcode reader or scanner sends and receives signaling to and from one or more host systems to verify and validate the redemption of a game voucher or promotional coupon inserted into the barcode reader or scanner.

In another aspect of the invention, a barcode reader or scanner sends and receives signaling to and from one or more host systems, the signaling including device status, among others.

In another aspect of the invention, a barcode reader or scanner accepts and/or rejects a game voucher and/or a promotional coupon for redemption.

In another aspect of the invention, a secured gaming table device includes a bill validator to scan inserted currency for the validation, verification, and authentication of such and/or to detect counterfeit currency.

In another aspect of the invention, a bill validator sends and receives signaling from one or more host systems, the signaling can include device status, among others.

In another aspect of the invention, a secured gaming table device includes a keypad for the validation, verification, and issuance of game vouchers and/or promotional coupons from the gaming table.

In another aspect of the invention, a keypad receives input such as a cash-in amount, a verification number, or a validation number, among others.

In another aspect of the invention, a keypad provides for the validation and/or verification of game vouchers and/or promotional coupons inserted for redemption.

In another aspect of the invention, a keypad sets a denomination to use at a gaming table.

In another aspect of the invention, a keypad allows an authorization code to be entered.

In another aspect of the invention, one or more controllers for a secured gaming table device interface with one or more host systems.

In another aspect of the invention, one or more controllers control any or all operations of the secured gaming table device or any or all operations of any component thereof; each controller internal or external to the secured gaming table device and/or any component.

In another aspect of the invention, a secured gaming table device includes a user interface; the user interface being a single or dual interface.

In another aspect of the invention, a user interface provides a visual interface with one or more host systems for the issuance, redemption, validation, and verification of game vouchers and/or promotional coupons at a gaming table.

In another aspect of the invention, a secured gaming table device includes a card reader/writer to read and write/encode media, such as media with a magnetic stripe.

In another aspect of the invention, a secured gaming table device includes a RFID sensing and/or reading device which allows an RFID read of the RFID chips when the RFID chips are compiled or placed in a specified region on a gaming table, the RFID read of the chips signaling the secured gaming table device as to the amount of the cash-out, the amount being recorded in the memory of the secured gaming table device and posted to the external display of the secured gaming table device.

In another aspect of the invention, a secured gaming table device connects to a user interface such as feedback lights to provide signaling which someone such as an operator or dealer might otherwise miss.

In another aspect of the invention, a secured gaming table device includes an external display to provide visual means for data verification and/or validation, among others.

In another aspect of the invention, a secured gaming table device includes an entry point or a lit ring into which to push the chips, the entry point or lit ring flashing providing signaling to the dealer, among others.

In another aspect of the invention, a secured gaming table device connects to any one or more of the following host systems: an accounting system, a TITO system, a Slot Machine Interface Board (SMIB), a PTS, a gaming chip issuance/redemption and/or tracking system, a promotional couponing system, a cash-out vouchering system, a point-of-sale system (POS), and other(s), among others.

In another aspect of the invention, a secured gaming table device connects to one or more host systems in any one or more means such as a direct connection, indirectly through another connected system, or through a slot machine interface board (SMIB), wherein the connection uses standard or non-standard slot machine protocol.

In another aspect of the invention, a secured gaming table device connects to one or more host systems via a serial connection, a network connection, a wireless communication or any combination thereof.

In another aspect of the invention, a secured gaming table device processes game vouchers, promotional coupons, player tracking cards, thermally rewritable cards, credit cards, and/or debit cards, among others.

In another aspect of the invention, an interface to one or more host systems sends and receives signaling from one or more host systems, the signaling including a security code or authentication code for the verification and/or validation of the issuance and redemption of game vouchers and/or promotional coupons at a gaming table.

In another aspect of the invention, a secured gaming table device interfaces with one or more host systems for the validation and/or verification of the issuance and/or redemption of game vouchers and/or promotional coupons.

In another aspect of the invention, a secured gaming table device interfaces with one or more host systems for transmitting data related to game vouchers, game voucher transactions, promotional coupons, promotional coupon transactions, transaction receipts, a combination of any, or a combination of all.

In another aspect of the invention, a secured gaming table device includes a personal identification number (PIN) device for security of access, said PIN device being tethered or mounted, said PIN device being a PIN keypad, a bio metric security feature, or a combination of both.

In another aspect of the invention, a keypad, user interface, security code, and interface to one or more host systems includes the secured means by which game vouchers and voucher transactions are verified and/or validated at a gaming table by authorized personnel.

In another aspect of the invention, a keypad, user interface, security code, and interface to one or more host systems includes the secured means by which promotional coupons and promotional coupon transactions are verified and/or validated at a gaming table by authorized personnel.

In another aspect of the invention, a keypad, user interface, security code, and interface to one or more host systems includes the secured means by which winnings from a gaming table are verified and/or validated at a gaming table by authorized personnel.

In another aspect of the invention, a secured gaming table device can access and rotate game vouchers, promotional coupons, thermally rewritable cards, credit cards, and/or debit cards to provide a low profile and more desirable physical profile of the device.

In another aspect of the invention, a method of using a secured gaming table device where the secured gaming table device processes a total transaction and divides and distributes the total transaction amount into any one or any combination of chips, one or more game vouchers and/or promotional coupons.

In another aspect of the invention, a method of reading and writing magnetic stripe data by a secured gaming table device is accomplished by moving a card over or through a fixed or stationary card reader/writer, the operation being manual or motorized.

In another aspect of the invention, a method of reading and writing magnetic stripe data by a secured gaming table device is accomplished by moving a card reader/writer over a card which is stationary, the operation being manual or motorized.

BRIEF DESCRIPTION OF THE DRAWINGS

These and other features, aspects, and advantages of the present invention will become better understood with regard to the following description, accompanying drawings and appendix where.

Identically labeled elements appearing in different ones of the figures refer to the same elements but may not be referenced in the description for all figures.

DETAILED DESCRIPTION OF THE INVENTION

Figure 1A:
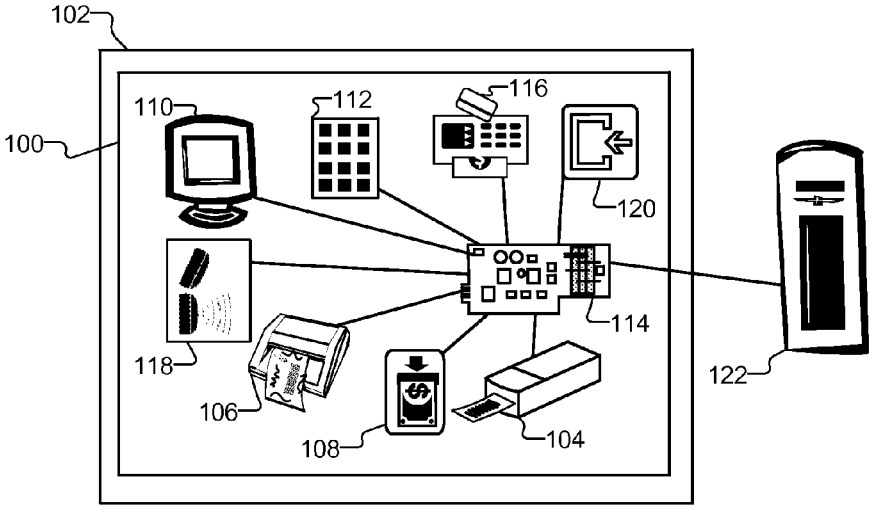
FIG. 1*a* is an illustration of the components of a secured gaming table device in accordance with an exemplary embodiment of the present invention.

FIG. 1*a* is an illustration of the components of a secured gaming table device in accordance with an exemplary embodiment of the present invention. Any component can be optional and/or combined with one or more components.

A secured gaming table device 100 uses ticket-in and ticket-out (TITO) and RFID technology to allow gaming establishments to use and exchange game vouchers, winnings from slot machines, promotions, and promotional coupons, to provide cashless payout from a gaming table, to provide transaction receipts, and to link gaming tables 102 and connect and use host systems 122 in use, such as the TITO System and PTS, for credit transfer to and from game vouchers, player tracking cards, promotional coupons, cash, RFID chips, and non-RFID chips, among others, thereby expanding the use of credit transfer within a gaming establishment and or associated gaming establishments and their slot machines, change machines, and cashier cages to include gaming tables.

As illustrated, a secured gaming table device 100 connects to a gaming table 102. The secured gaming table device includes a gaming printer 104, barcode reader or scanner 106, bill validator 108, user interface 110, keypad 112, card reader/writer 116, a RFID sensing and/or reading device 118, an entry point 120, and controller 114, among others not illustrated. Any or all components are internal or external to the secured gaming table device. Additionally, the gaming printer and card reader/writer can be one component. The secured gaming table device and/or components thereof connect to one or more host systems 122 for the issuance and redemption of game vouchers and/or promotional coupons at a gaming table, the game vouchers and/or promotional coupons generated by the printer in the secured gaming table device. Additional detail on host systems is disclosed in FIG. 2.

A secured gaming table device 100 processes game vouchers, promotional coupons, PTS cards, thermally rewritable cards, credit cards, and/or debit cards, among others. Additionally, a game voucher and/or promotional coupon consist of thermal paper, thermal rewritable media or smart cards such as commonly used debit and/or credit cards for financial transactions. Information storage on the media include magnetic encoding of which is read and/or written using a RFID sensing and/or reading device 118 as later disclosed.

The gaming printer 104 generates game vouchers and/or one or more promotional coupons, for example, upon receiving a cash-out signal. The cash-out data is transmitted to one or more host systems 122.

The gaming printer 104 sends and receives signaling to and from one or more host systems 122 to generate game vouchers and/or promotional coupons. Additionally, the signaling can include the completion of a print job such as a game voucher or promotional coupon and printer status such as paper low, among others.

The printer 104 also prints transaction receipts, such as a receipt for a draw of chips requested by a player. Additional details are disclosed in FIG. 9.

The barcode reader or scanner 106 scans the barcode of a game voucher and/or one or more promotional coupons upon receiving a cash-in or coupon-in signal. The barcode data is transmitted to one or more host systems 122 for validation and verification.

The barcode reader or scanner 106 accepts or rejects game vouchers and/or promotional coupons. The barcode reader or scanner scans the barcode and/or other indicia or data of each game voucher and/or promotional coupon inserted into such device for the validation and/or verification of such. The barcode reader or scanner sends and receives signaling to and from one or more host systems 122 to verify and validate the redemption of a game voucher or promotional coupon inserted into a barcode reader or scanner. Additionally, the signaling can include device status, among others.

The bill validator 108 scans inserted currency for the validation, verification, and authentication of such and/or to detect counterfeit currency. The bill validator sends and receives signaling to and from one or more host systems 122, the signaling can include device status, among others.

In one embodiment, the barcode reader or scanner 106 and the bill validator 108 is one device performing any or all the functions described herein for a barcode reader or scanner and bill validator.

The user interface 110 provides the visual interface with one or more host systems 122 for the issuance, redemption, validation, and verification of game vouchers and/or promotional coupons at a gaming table 102. The user interface includes a device such as a monitor, display, or touch screen, among others. In one embodiment, the user interface is a single interface. In another embodiment, the user interface is a dual interface.

The user interface 110 provides signaling which someone such as an operator or dealer might otherwise miss. An example user interface includes feedback lights.

The keypad 112 provides for the secured validation and/or verification of game vouchers and/or promotional coupons inserted for redemption at a gaming table 102. The keypad also serves as a secured means by which game vouchers, game voucher transactions, promotional coupons, promotional coupon transactions, a combination of any, or a combination of all is verified and/or validated at a gaming table; the transactions includes any win from a gaming table. Additionally, the keypad is used to request a cashout from a gaming table and/or provide the electronic means by which a player can play at a gaming table.

The keypad 112 receives input such as a cash-in amount, cash-out amount, a verification number, or a validation number, among others.

Additionally, the keypad 112 sets a denomination to use at a gaming table 102. In this embodiment, authorized personnel such as a pit boss or manager uses the keypad to manually enter and set a denomination, the denomination of which also is set by a host system 122 such as a denomination server. A user interface 110 is used to visually verify the denomination. Additional details are disclosed in FIG. 7.

The keypad 112 includes wired and/or wireless technology. The keypad also allows a player to enter an authorization code which is passed encrypted through to a central server or host system 122. The authorization code is used, for example, to make a marker draw for chips. In this embodiment, the printer 104 prints one or more receipts of the transaction as part of the authorization completion.

The card reader/writer 116 reads the magnetic stripe and writes data to the magnetic stripe of media such as a rewritable card, credit card, debit card, and/or smart card, among others. Examples of the use of this type media include a PTS card.

The RFID sensing and/or reading device 118 reads RFID chips, for instance, when the RFID chips are compiled or placed in a specified region on a gaming table 102. The RFID read of the chips signals the secured gaming table device 100 as to the amount of the cash-out. The amount is recorded in the memory of the secured gaming table device and posted to the user interface 110 of the secured gaming table device. Additionally, the RFID sensing and/or reading device reads RFID tags or fibers from a rewritable card or smart card, among others.

The entry point or lit ring 120 provides signaling to the dealer or others, for instance, flashing when chips are pushed in the entry point of the device 100.

The controller 114 controls any or all operations of said secured gaming table device 100 or any or all operations of any component thereof. In another embodiment, a controller exists for each component such as for the printer 104.

The controller 114 interfaces with one or more host systems 122 to send and receive signaling, the signaling includes a security code or authentication code for the verification and/or validation of the issuance and redemption of game vouchers or promotional coupons inserted into a barcode reader or scanner 106. The controller connects to the printer 104, barcode reader or scanner 106, bill validator 108, user interface 110, keypad 112, card reader/writer 116, RFID sensing and/or reading device 118, and entry point 120 among others and is internal or external to one or more components of the secured gaming table device 100.

In one embodiment, the secured gaming table device 100 uses the controller 114 to interface with one or more host systems 122 for the validation and/or verification of the issuance and/or redemption of one or more game vouchers and/or promotional coupons. One or more host systems includes the means for transmitting data related to game vouchers, game voucher transactions, promotional coupons, promotional coupon transactions, transaction receipts, a combination of any, or a combination of all.

In another embodiment, the gaming printer 104, barcode reader or scanner 106, bill validator 108, user interface 110, and keypad 112 among others connect to a controller 114 and the controller connects to one or more host systems 122.

In another embodiment, each component such as a gaming printer 104 connects to a separate controller 114 where each controller is internal or external to each component. Each controller connects to one or more host systems 122.

In another embodiment, a game voucher or promotional coupon is inserted for redemption into the barcode reader or scanner 106 at a gaming table 102. Once the voucher or coupon is verified and validated, the appropriate amount is made available for play at the gaming table. Upon cashout at a gaming table, the gaming printer 104 generates a voucher with the appropriate amount of credits and/or promotional coupons.

In another embodiment, a pit boss or other authorized individual orders a promotion or promotional coupon for a desirable player. This is done during a cash in, a play session, or a cash out of a gaming table 102. The promotion or promotional coupon then is generated by the printer 104 of the secured gaming table device 100 or at a central location (not shown) to be presented to the player by the pit boss or other authorized individual.

In another embodiment, a secured gaming table device 100 connects to a gaming table 102 and one or more host systems 122 (as disclosed in FIG. 2) to transfer credits, generate game vouchers and/or promotional coupons other items of interest, and issue awards to a player.

In another embodiment, the secured gaming table device 100 reads RFID chips using the RFID sensing and/or reading device 118 to process a cash-out signal to generate a game voucher comprising a value equal to or less than the total amount of RFID chips or winnings from a gaming table 102. Additionally, data from one or more RFID chips or the total of a chip read is sent, for example, to a promotional couponing system 212 (of FIG. 2) to link the data. This is useful to build a player driven matrix or target a particular patron or customer type. For the player driven matrix, the RFID data can include total chip read from multiple sessions played by the player.

This data is appended to other data for the same player, such as winnings from a slot machine and purchases made, among others. Additionally, the RFID data and others of the promotional couponing system are used to promote a PTS.

In another embodiment, a secured gaming table device 100 connects to a point-of-sale system 216 (of FIG. 2) to generate promotional coupons and other items of interest to patrons of a gaming establishment and/or associated gaming establishments.

In another embodiment, the card reader/writer 116, either internal or external, connects to the keypad 112 to transfer an amount or a portion of an amount to or from a PTS card or other card to exchange for cash, vouchers, coupons, or any combination thereof. In another embodiment, the card reader/writer and keypad are external handheld devices.

Figure 1B:
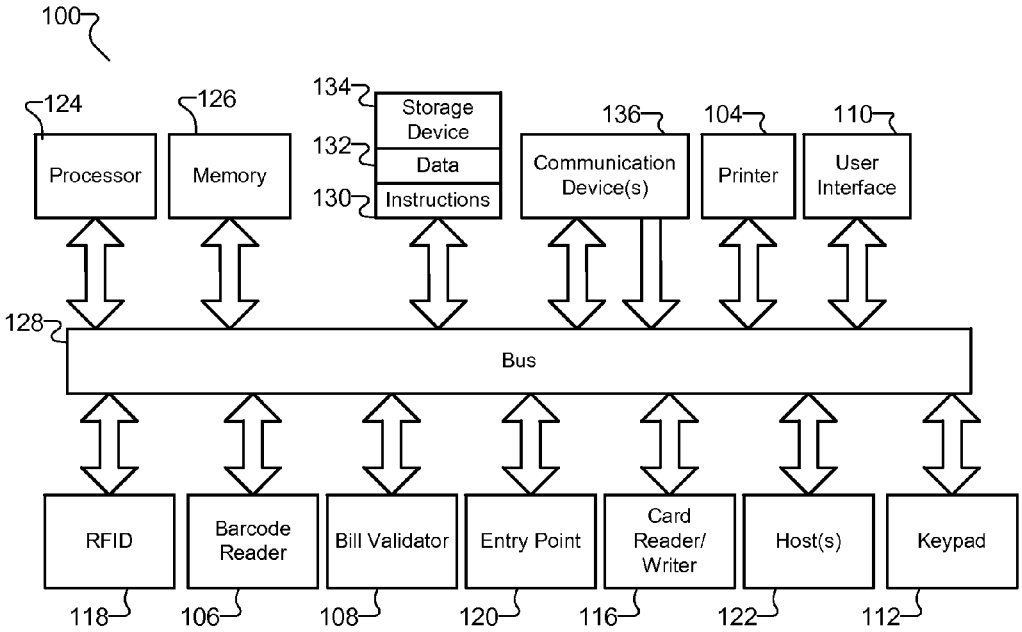
FIG. 1*b* is a block diagram of a secured gaming table device and components thereof in accordance with an exemplary embodiment of the present invention.

FIG. 1*b* is a block diagram of a secured gaming table device and components thereof in accordance with an exemplary embodiment of the present invention. Any component can be optional and/or combined with one or more components.

A secured gaming table device 100 contains the programming instructions 130, memory 126, security and interface means, among others necessary for signaling and data transfer of one or more files for data verification and other purposes.

A secured gaming table device 100 includes a processor 124, operatively connected via a bus 128 to a memory 126. The processor is further operatively connected via the bus to a storage device 134. Program instructions 130 and data 132 implementing previously described voucher, coupon, and card processes, among others, are stored in the storage device until the processor retrieves the program instructions and stores them in the memory. The processor then executes the program instructions stored in the memory and uses the data to implement the features of the secured gaming table device and processes as described herein.

The processor 124 is further connected via the bus 128 to one or more communication devices or ports 136. The secured gaming table device 100 uses the communication devices to transmit and receive control signals for example from a host system such as a Promotional Couponing System 212 (of FIG. 2), gaming system or gaming machine as described herein. Additionally, a communication device or port connects to external devices such as a slot machine or gaming table 102 (of FIG. 1*a*), among others.

The processor 124 is further connected via the bus 128 to the gaming printer 104. The secured gaming table device 100 uses the gaming printer to generate vouchers, promotional coupons, and/or transaction receipts among others as described herein.

The processor 124 is further connected via the bus 128 to the user interface 110. The secured gaming table device 100 uses the user interface to provide a visual interface and/or signaling among others as described herein.

The processor 124 is further connected via the bus 128 to the RFID sensing and/or reading device 118. The secured gaming table device 100 uses the RFID sensing and/or reading device to read RFID chips among others as described herein.

The processor 124 is further connected via the bus 128 to the barcode reader or scanner 106. The secured gaming table device 100 uses the barcode reader or scanner to scan the barcode of a game voucher or promotional coupon among others as described herein.

The processor 124 is further connected via the bus 128 to the bill validator 108. The secured gaming table device 100 uses the bill validator to scan inserted currency among others as described herein.

The processor 124 is further connected via the bus 128 to the entry point 120. The secured gaming table devices 100 uses the entry point to provide signaling among others as described herein.

The processor 124 is further connected via the bus 128 to the card reader/writer 116. The secured gaming table device 100 uses the card reader/writer to read and write to the magnetic stripe of media among others as described herein.

The processor 124 is further connected via the bus 128 to the keypad 112. The secured gaming table device 100 uses the keypad to input data among others as described herein.

The processor 124 is further connected via the bus 128 to one or more host systems 122 for the validation and/or verification of the issuance and/or redemption of game vouchers and/or promotional coupons among others as described herein.

Figure 2:
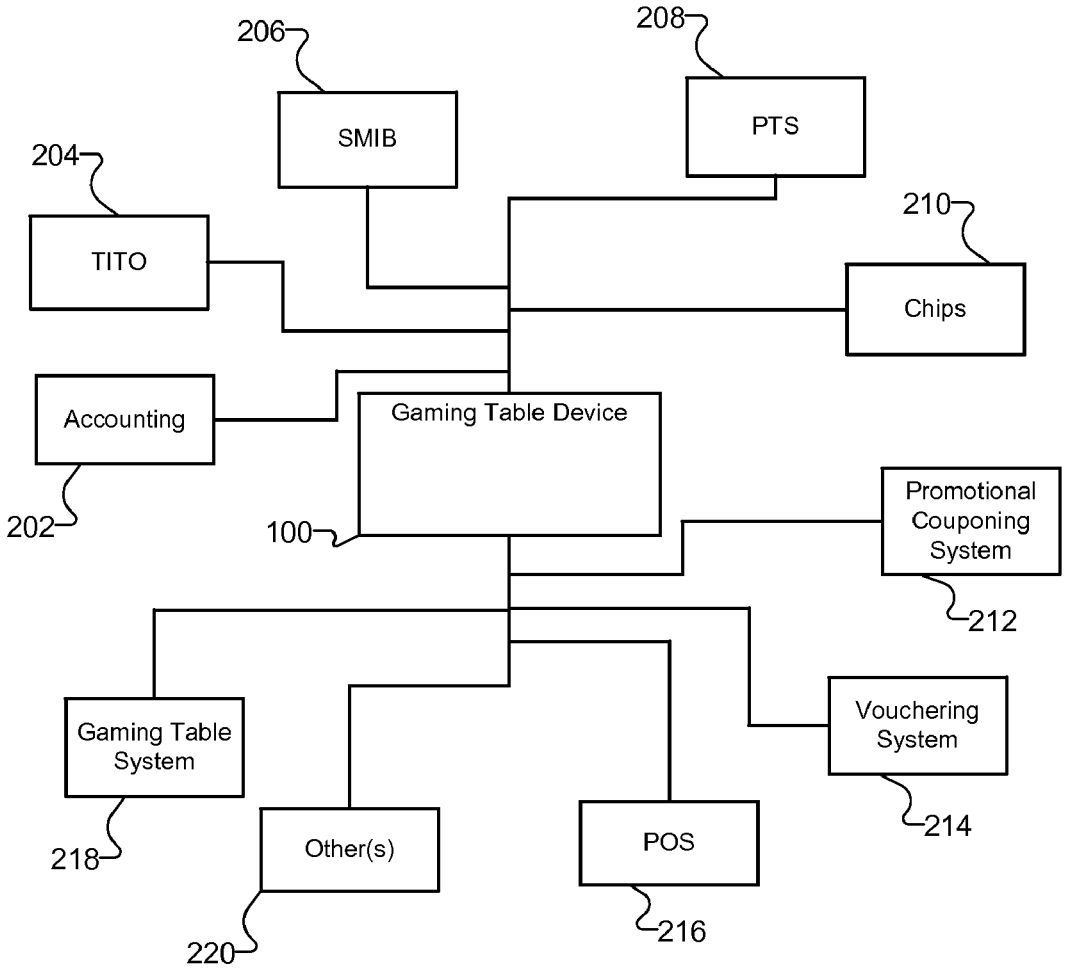
FIG. 2 is a block diagram of a secured gaming table device connected to various host systems in accordance with an exemplary embodiment of the present invention.

FIG. 2 is a block diagram of a secured gaming table device connected to various host systems in accordance with an exemplary embodiment of the present invention.

As illustrated, a secured gaming table device 100 connects to any one or combination of the following host systems for data processing, data verification, and or data validation, among others: an accounting system 202, a TITO system 204, a Slot Machine Interface Board (SMIB) 206, a Player Tracking System (PTS) 208, a gaming chip issuance/redemption and/or tracking system 210, a promotional couponing system 212, a cash-out vouchering system 214, a point-of-sale system (POS) 216, a Gaming Table System 218, and other(s) 220, among others not shown.

An accounting system 202 processes data related to any or all financial transaction that occurs within a gaming establishment and or associated gaming establishments.

A TITO system 204 controls the issuance and redemption of game vouchers within a gaming establishment and or associated gaming establishments.

A Slot Machine Interface Board (SMIB) 206 processes data related to issuance and redemption of game vouchers and or promotional coupons. The SMIB manages transactions of a slot machine, such as money in, money out, bills and tickets inserted, jackpots paid, etc.

A Player Tracking System (PTS) 208 monitors game play activity by participating patrons. Additionally, data from the PTS is used by a secured gaming table device 100 to personalize a promotional coupon and/or issue awards to the player's card. Additional details are disclosed in FIG. 11.

A gaming chip issuance/redemption and/or tracking system 210 monitors play activity at a gaming table 102 (of FIG. 1*a*). Additionally, gaming chips containing RFID are electronically tracked by the system and read by the secured gaming table device 100.

A promotional couponing system 212 creates and manages promotional coupons. The promotional couponing system controls and performs the printing of promotional coupons and other items of interest to patrons of a gaming establishment and or associated gaming establishments.

A cash-out vouchering system 214 creates cash-out voucher records and issues data packets that are used by a printer 104 (of FIG. 1*a*) in a game such as a slot machine to print a cash-out game voucher.

A point-of-sale system (POS) 216 is installed in a gaming establishment in various locations where business is transacted, such as a retail shop, restaurant, ticket sales counter, front desk, etc. The POS monitors and controls transaction activity, typically through a cash register and other peripherals.

The Gaming Table System 218 manages and controls the gaming tables 102 (of FIG. 1*a*) in use at a gaming establishment.

Other(s) systems 220 include a lodging management system that monitors and tracks a patron's lodging as well as one or more links to financial institutions for verification and processing of credit cards and/or debit cards, among others.

In one embodiment, a secured gaming table device 100 connects to one or more host systems such as a Promotional Couponing System 212 in any one or more means such as a direct connection, indirectly connected through another connected system such as a PTS 208, or connected through a slot machine interface board (SMIB) 206.

In another embodiment, the connection uses a standard game protocol. In another, the connection uses a nonstandard game protocol.

In another embodiment, a secured gaming table device 100 connects to one or more host systems using one or more connections such as a serial connection, a network connection, or a wireless connection.

Figure 3:
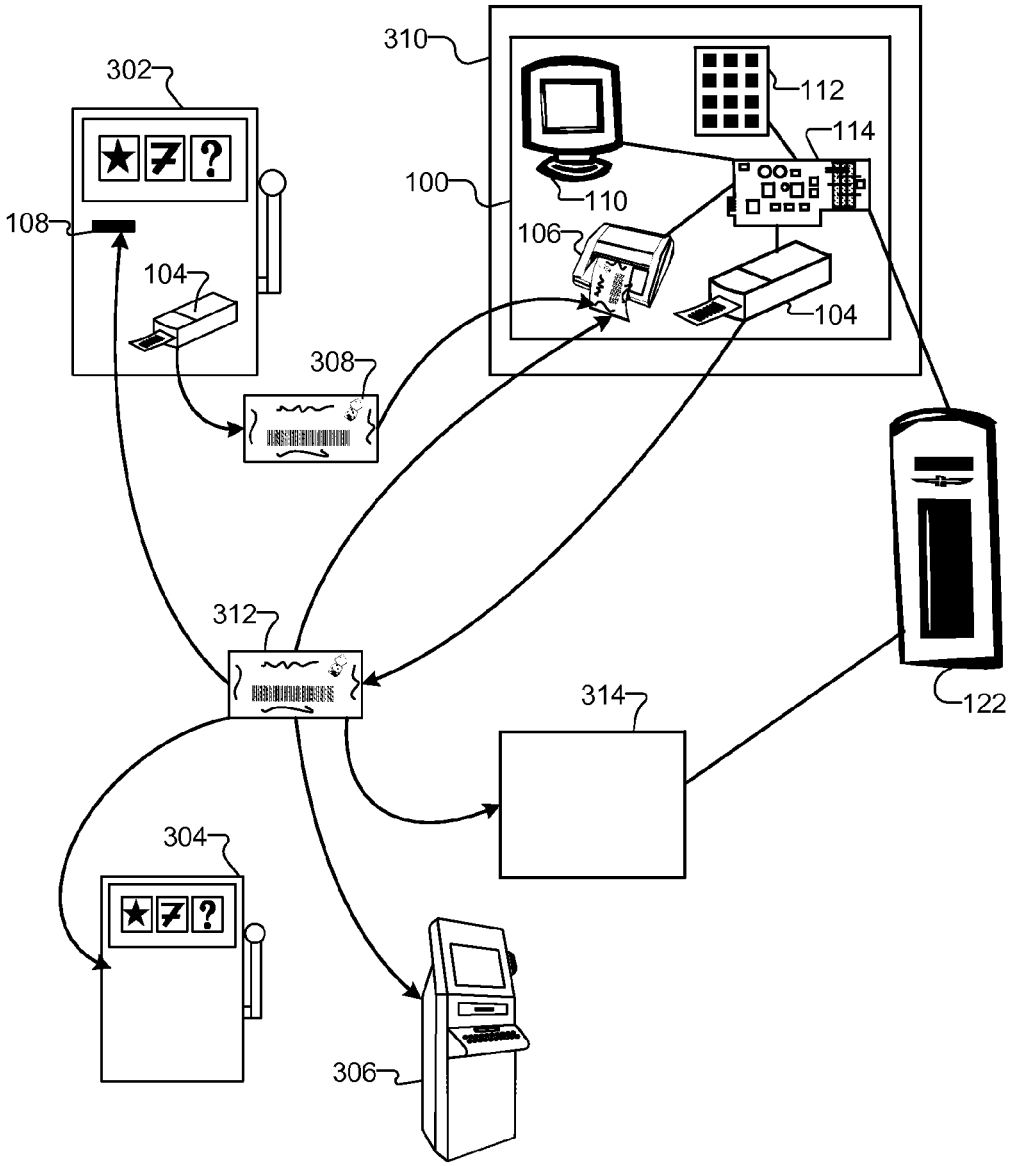
FIG. 3 is an illustration of game vouchers and/or promotional coupons issued and redeemed in accordance with an exemplary embodiment of the present invention.

In an embodiment of a cash-in, when a customer presents a game voucher or promotional coupon to the entry point 120 (of FIG. 1*a*) of the secured gaming table device 100, a cash-in signal such as the one later disclosed in FIG. 3 is processed. Using the barcode reader/scanner 106 (of FIG. 1*a*), the secured gaming table device reads the unique ID or serial number from the game voucher. The unique ID is transmitted to a host system such as the TITO host system 204 for validation. The host validates the unique ID and signals the secured gaming table device as to the value of the game voucher or promotional coupon for exchange of chips at the table or for good and or services at any other associated point of sale 216.

Additionally, the value of the game voucher or promotional coupon is indicated on the user interface 110 (of FIG. 1*a*).

In another embodiment, the actual value or a determined value of the game voucher or promotional coupon is indicated by the user interface 110 and/or entry point 120 (both of FIG. 1*a*). For example, a gaming establishment determines that any game voucher or promotional coupon with a value of $200 is eligible for a certain promotion. When a customer having a game voucher meeting this requirement inserts the game voucher into the secured gaming table device 100, the user interface and/or entry point provides flashing lights or some other visual indicator for eligibility for one or more promotions.

Figure 5:
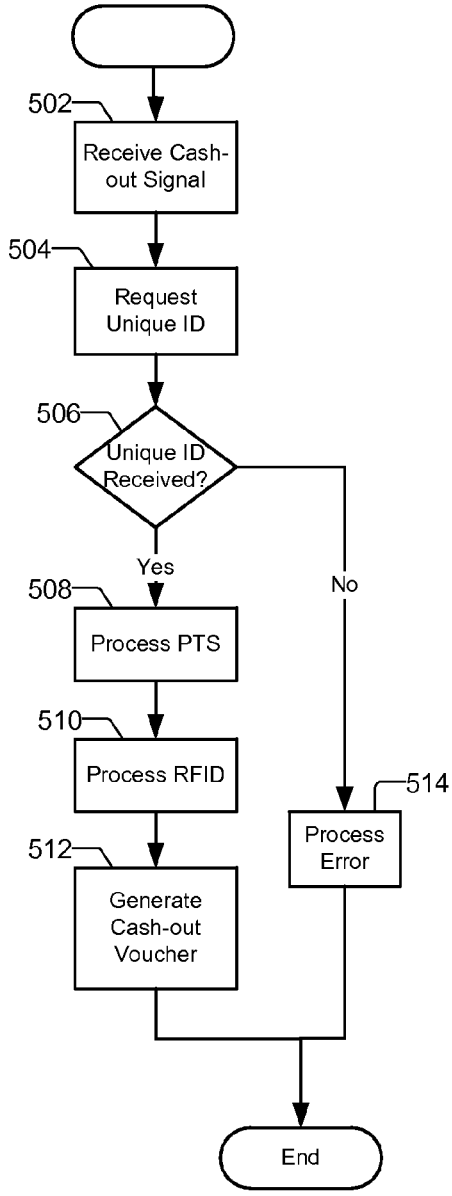
FIG. 5 is a flow chart diagram of a cash-out process in accordance with an exemplary embodiment of the present invention.

In the operation of a cash-out embodiment similar to when a customer presses the cashout button on a slot machine or other gaming machine, at the end of a game when chips are cashed or at the end of a transaction for goods and or services that require change to be paid to the customer, a cash-out signal such as the one later disclosed in FIG. 5 is processed. A unique ID and possibly additional data then is transmitted to the requesting secured gaming table device 100 where the requesting secured gaming table device generates a game voucher or promotional coupon using the unique ID.

Additionally, a user such as a gaming table dealer enters an amount to be returned to the customer using a keypad 112 (of FIG. 1*a*). Using a user interface 110 (of FIG. 1*a*), a user visually can verify the entered amount. In this embodiment, if the value exceeds the approved limit for a dealer, a gaming table supervisor uses the keypad to authorize the transaction. Once the value is entered, the secured gaming table device 100 requests a unique ID from one or more host systems 122 for the value of the transaction.

FIG. 3 is an illustration of game vouchers and/or promotional coupons issued and redeemed in accordance with an exemplary embodiment of the present invention.

Each gaming machine such as a slot machine 302 and 304 includes a bill acceptor/validator 108 and gaming printer 104, among other components not shown, but known to those skilled in the art.

Each secured gaming table device 100 includes those previously disclosed in FIG. 1*a* and FIG. 1*b*.

The one or more host systems 122 are previously disclosed in FIG. 1*a*, FIG. 1*b*, and FIG. 2.

The point of redemption 306 includes any kiosk, point-of-sale, cashier's cage, or other having the necessary components such as a barcode reader or scanner 106 (of FIG. 1*a*) where a player can redeem a game voucher or promotional coupon.

In one embodiment, when a player with credit and/or winnings in a gaming machine 302 cashes out of the gaming machine, the player receives media such as a game voucher 308 containing the appropriate cashout value such as in dollars. If the player decides to play at a gaming table 310, the player inserts the same game voucher into the barcode reader or scanner 106 of the secured gaming table device 100. The barcode reader or scanner scans the inserted game voucher. Additionally, a keypad 112 and/or user interface 110 connected to a controller 114, and security code is used with one or more host systems 122 to verify and/or validate an inserted game voucher. If accepted, any or all the amount from the value of the inserted game voucher is played at the gaming table by the player.

When the player with credit and/or winnings at the gaming table 310 cashes out of the gaming table, a keypad 112 and/or user interface 110 connected to a controller 114, and security code is used with one or more host systems 122 to verify and/or validate a game voucher 312 generated by the gaming printer 104 at the gaming table. In turn, the player can take the game voucher generated at the gaming table and play the game voucher in a gaming machine 302, another gaming machine 304, the same gaming table 310, or another gaming table 314. Additionally, the player can cashout the game voucher at a point of redemption 306.

The previously described operation also applies to promotions and promotional coupons for gaming that were issued to a player, such as a free play coupon.

In another embodiment, the player or any authorized personnel at a gaming table 310 enters a security code using a keypad 112.

In another embodiment, a player cashes in at a gaming table 310 by inserting currency into the bill validator 108 (of FIG. 1*a*) of the secured gaming table device 100. The bill validator runs tests, such as random tests on the inserted currency to detect counterfeit currency, among others. Additional details are disclosed in FIG. 8.

In another embodiment, the means for a keypad 112 and user interface 110 is a touch screen display.

In another embodiment, when a player wants to cash out the gaming table 310, the player presses a cashout button which functions similar to that of a slot machine 302 or 304 after which a printer 104 connected to the secured gaming table device 100 generates a game voucher 312 containing the appropriate cashout value such as in dollars.

Figure 4:
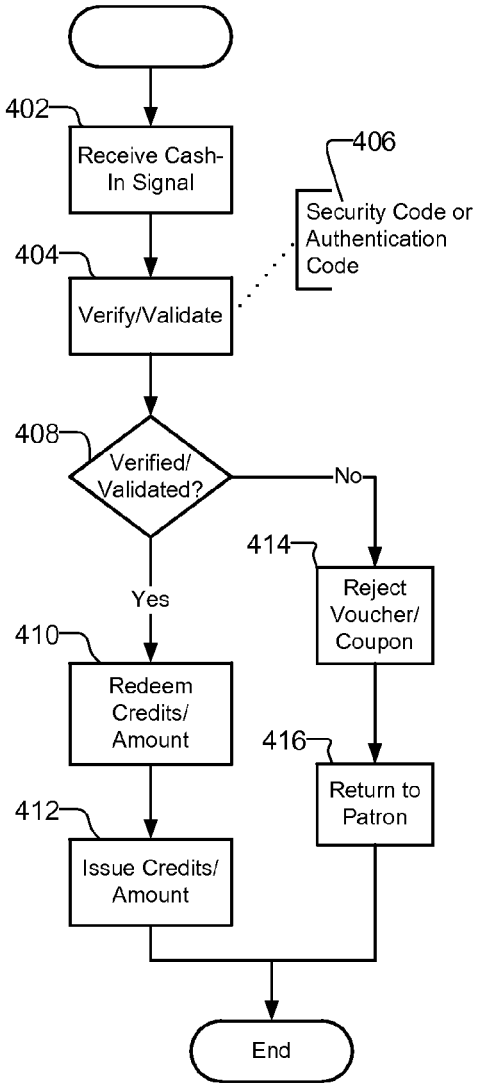
FIG. 4 is a diagram of the cash-in verification and validation process in accordance with an exemplary embodiment of the present invention.

FIG. 4 is a diagram of the cash-in verification and validation process in accordance with an exemplary embodiment of the present invention.

As illustrated, the process begins with receive cash-in signal 402 which determines that a game voucher and/or promotional coupon was inserted for redemption into a barcode reader or scanner 106 (of FIG. 1*a*) connected to a secured gaming table device 100 (of FIG. 1*a*). In verify/validate 404, a security code or authorization code 406 is entered using a keypad 112 (of FIG. 1*a*) or the code is generated by one or more host systems 122 (of FIG. 1*a*). Any or all the data or contents of the game voucher and/or promotional coupon is verified and validated 408 against data from one or more host systems. The data or contents include a validation number, a date, a time, a ticket number, a void after period, and a barcode, among others.

If the game voucher or promotional coupon or contents thereof is verified and validated, the process continues with redeem credits/amount 410 where one or more host systems 122 (of FIG. 1*a*) signals a secured gaming table device 100 (of FIG. 1*a*) to redeem the voucher or coupon. Thereafter, the appropriate amount of credits is issued 412 to a player in the form of cash, gaming table tokens, electronic credit, or a combination of any or all, among others after which the process ends.

If for any reason one or more host systems 122 (of FIG. 1*a*) cannot verify or validate the game voucher or promotional coupon or contents thereof, the voucher or coupon is rejected 414 and is returned to the player 416 after which the process ends.

The previously described cash-in process also functions with currency inserted into the bill validator 108 (of FIG. 1*a*) of a secured gaming table device 100 (of FIG. 1*a*). In this embodiment, the currency is validated 404 using, for example, the process of FIG. 8. Once validated 408, the process continues with redeem credits/amount 410 where one or more host systems 122 (of FIG. 1*a*) signals a gaming table 102 (of FIG. 1*a*) to issue credits 412 to a player in the form of cash, gaming table tokens, electronic credit, or a combination of any or all, among others.

Additionally, one or more host systems 122 (of FIG. 1*a*) are notified of the rejected voucher, coupon, or currency.

FIG. 5 is a flow chart diagram of a cash-out process in accordance with an exemplary embodiment of the present invention.

As illustrated, the process begins with receive cash-out signal 502 which, for example, occurs at the end of a game when chips are cashed or at the end of a transaction for goods and or services that require change to be paid to the customer. The secured gaming table device 100 (of FIG. 1*a*) then requests a unique ID 504 from one or more host systems 122 (of FIG. 1*a*). In one example, the unique ID is a serial number or transaction number. The unique ID and possibly additional data then are transmitted to the requesting secured gaming table device. If the requesting secured gaming table device receives the unique ID 506, the process continues with process PTS 508 (as exemplified in FIG. 11), followed by process RFID 510 where data from one or more RFID chips or the total of a chip read is sent, for example, to a promotional couponing system 212 (of FIG. 2) to link the data. This is useful to build a player driven matrix or target a particular patron or customer type. For the player driven matrix, the RFID data can include total chip read from multiple sessions played by the player. This data is appended to other data for the same player, such as winnings from a slot machine and purchases made, among others. Additionally, the RFID data and others of the promotional couponing system are used to promote a PTS.

The process continues with generate cash-out voucher 512 where the requesting secured gaming table device 100 (of FIG. 1*a*) generates a game voucher or promotional coupon using the unique ID after which the process ends.

If the requesting secured gaming table device 100 (of FIG. 1*a*) does not receive the unique ID, the process continues with process error 514 where, for instance, the secured gaming table device reports and displays an error after which the process ends.

Additionally, a user can enter an amount to be returned to the customer using a keypad 112 (of FIG. 1*a*).

Figure 6:
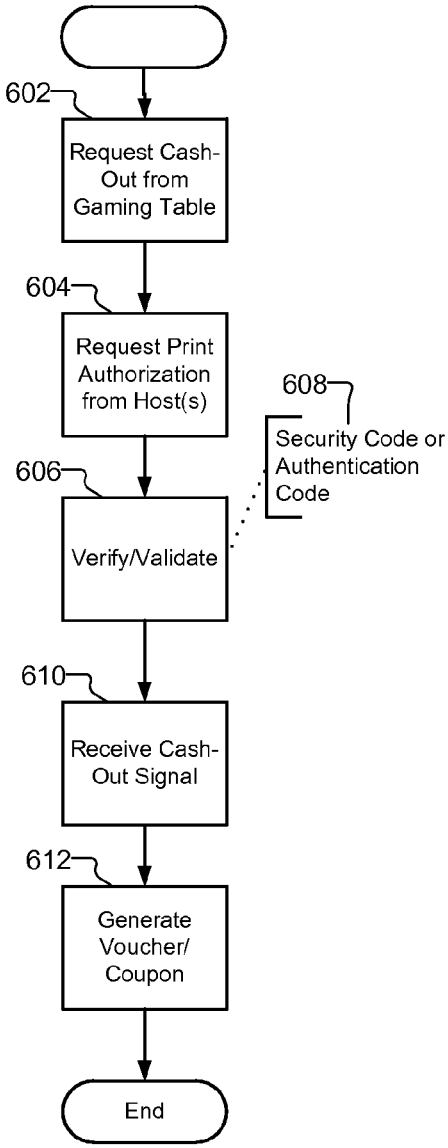
FIG. 6 is a diagram of the cash-out verification and validation process in accordance with an exemplary embodiment of the present invention.

FIG. 6 is a diagram of the cash-out verification and validation process in accordance with an exemplary embodiment of the present invention.

As illustrated, the process begins with request cash-out from gaming table 602 which, for example, is initiated by a player pressing a cash-out button similar to that of a slot machine. The process continues with request print authorization from host(s) 604 where the secured gaming table device 100 (of FIG. 1*a*) receives signaling from one or more host systems 122 (of FIG. 1*a*) to authorize the generation of a game voucher or promotional coupon.

In verify/validate 606, a security code or authorization code 608 is entered, for example, using a keypad 112 (of FIG. 1*a*) or the code is generated by one or more host systems 122 (of FIG. 1*a*). Any or all the data or contents of the game voucher and/or promotional coupon is verified and validated against data from one or more host systems. The data or contents include a validation number, a date, a time, a ticket number, a void after period, and a barcode, among others.

The process continues with receive cash-out signal 610 where one or more host systems 122 (of FIG. 1*a*) signal a secured gaming table device 100 (of FIG. 1*a*) or a printer 104 (of FIG. 1*a*) connected to the secured gaming table device to generate 612 the appropriate amount of credits in the form of a game voucher or promotional coupon after which the process ends.

Figure 7:
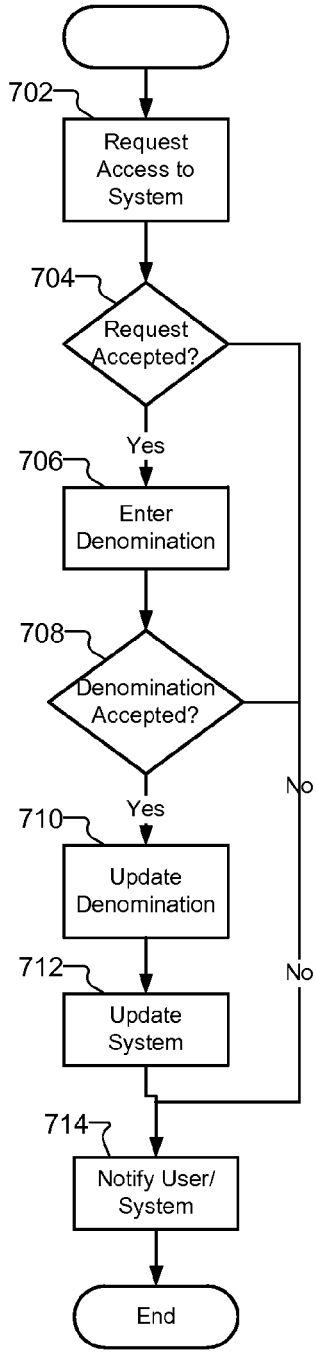
FIG. 7 is a flow chart of a set denomination process in accordance with an exemplary embodiment of the present invention.

FIG. 7 is a flow chart of a set denomination process in accordance with an exemplary embodiment of the present invention.

As illustrated, the process beings with request access to system 702 where, for example, an authorized individual can access a host system 122 (of FIG. 1*a*) either using a keypad 112 (of FIG. 1*a*) of the secured gaming table device 100 (of FIG. 1*a*) at the gaming table 102 (of FIG. 1*a*) or via a host system, such as a separate denomination server. The system begins a security check for rights to access the system.

If the request for access 704 is accepted, the process continues with enter denomination 706 where, for example, an authorized individual enters the denomination to use at the gaming table 102 (of FIG. 1*a*). If the request for access 704 is not accepted, the process continues with notify user/system 714 where the user and/or system receive notification that the request for access was not accepted after which the process ends.

If the denomination was accepted 708, the process continues update denomination 710 where the system signals and transmits to the secured gaming table device 100 (of FIG. 1*a*) the updated denomination to use. The process continues with update system 712 where data related to the updated denomination is processed and stored. Thereafter, the process continues with notify user/system 714 where the user and/or system receive notification that the denomination was updated after which the process ends.

If the denomination 708 was not accepted, the process continues with update user/system 714 where the user and/or system receive notification that the denomination was not accepted after which the process ends.

Figure 8:
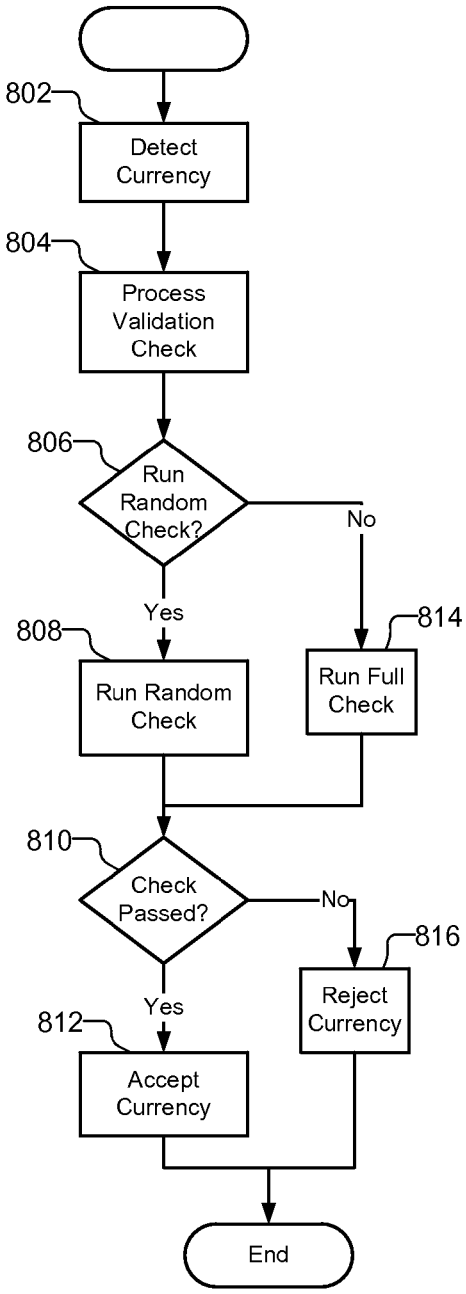
FIG. 8 is a flow chart of a bill validation process in accordance with an exemplary embodiment of the present invention.

FIG. 8 is a flow chart of a bill validation process in accordance with an exemplary embodiment of the present invention.

In one embodiment, a bill validator 108 (of FIG. 1*a*) in the secured gaming table device 100 (of FIG. 1*a*) operates an algorithm to randomly determine which sub-set of the full suite of tests it normally runs on currency. For example, if the bill validator normally runs eight various tests to determine that a bill is valid, then on a random basis, two of the eight tests would be run on each bill. One benefit to this is the cut down of bill validation time to ¼ of the normal time, making an inexpensive bill validator capable of much higher bill throughput. The random nature would ensure that counterfeit bills would have a high likelihood of getting rejected.

As illustrated, the process begins with detect currency 802 where currency is detected in the bill validator 108 (of FIG. 1*a*) of the secured gaming table device 100 (of FIG. 1*a*). The process continues with process validation check 804 where one or more validation checks are performed on the inserted currency.

If the determination is made to run a random check 806, the process continues with run random check 808 after which a determination is made to run a random check. If the random check passed 810, the process continues with accept currency 812 after which the process ends.

If no determination is made to run a random check 806 the process continues with run full check 814 after which a determination is if the full check passed 810. If the full check passed, the process continues with accept currency 812 after which the process ends.

If either check does not pass, the process continues with reject currency 816 after which the process ends.

Figure 9:
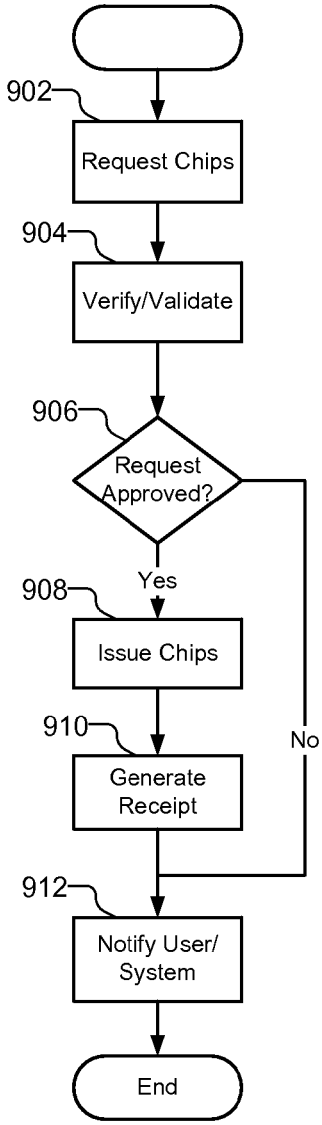
FIG. 9 is a flow chart of a request chips process in accordance with an exemplary embodiment of the present invention.

FIG. 9 is a flow chart of a request chips process in accordance with an exemplary embodiment of the present invention.

As illustrated, the process begins with request chips 902 where a player can use the keypad 112 (of FIG. 1*a*) to enter a request for chips and an authorization code which would be passed encrypted to a central server. In verify/validate 904, the central system verifies and validates the authorization code against codes stored in the database to approve the request.

If the request 906 is approved, the process continues with issue chips 908 where the requested chips are issued to the player and the printer 104 (of FIG. 1*a*) generates a transaction receipt 910 which is supplied to the player. The process continues with notify user/system 912 where the user and/or system are notified that chips were issued and a transaction receipt generated after which the process ends.

If the request 906 was not approved, the process continues with notify user/system 912 where the user and/or system are notified that the request was not approved after which the process ends.

Figure 10:
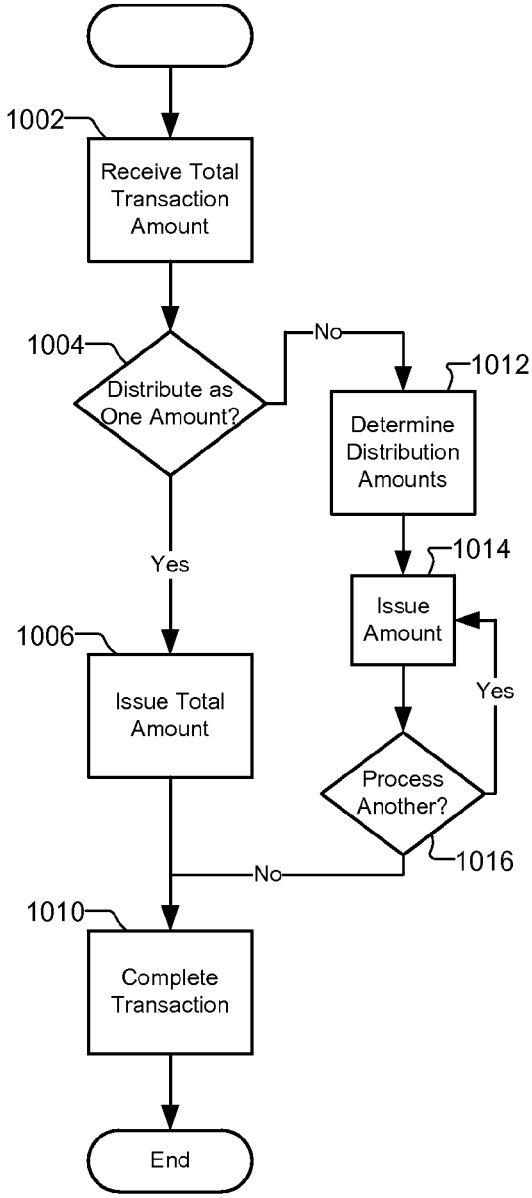
FIG. 10 is a flow chart diagram of a total transaction amount division process in accordance with an exemplary embodiment of the present invention.

FIG. 10 is a flow chart diagram of a total transaction amount division process in accordance with an exemplary embodiment of the present invention.

This process divides and distributes a total transaction amount into any one or any combination of chips, one or more TITO or game vouchers or tickets, and/or promotional coupons among others. For example, a total transaction amount of $1,000 is divided and distributed as $500 in chips and $500 in one or more game vouchers. Some human involvement may be necessary, such as a table dealer physically entering the amount of each distribution as well as a customer or patron authorizing the transaction and/or amount distribution.

As illustrated, the process begins with receive total transaction amount 1002, where, for example, after a credit card is charged, the total transaction amount is made available. If the amount is to be distributed as one amount 1004, the process continues with issue total amount 1006 where, for example, the amount is issued on a game voucher and the transaction is complete 1010 after which the process ends.

If the amount is to be distributed as multiple amounts, such as with chips and a game voucher, the process continues with determine distribution amounts 1012. For example, a $3,000 total transaction amount is distributed as chips worth $1,500, more game vouchers worth $1,250, and the purchase of more show tickets worth $250 based on a promotional coupon the customer or patron received.

After determining the distribution amounts 1012, the process continues with issue amount 1014. Continuing with our previous example, the $1,500 of chips are issued. Since there are additional distribution amounts to process 1016, the process loops back to issue amount 1014 where the secured gaming table device issues $1,250 in more game vouchers; then $250 in promotional coupons, for example, as show tickets. Once all amounts have been distributed, the transaction is complete 1010 after which the process ends.

Figure 11:
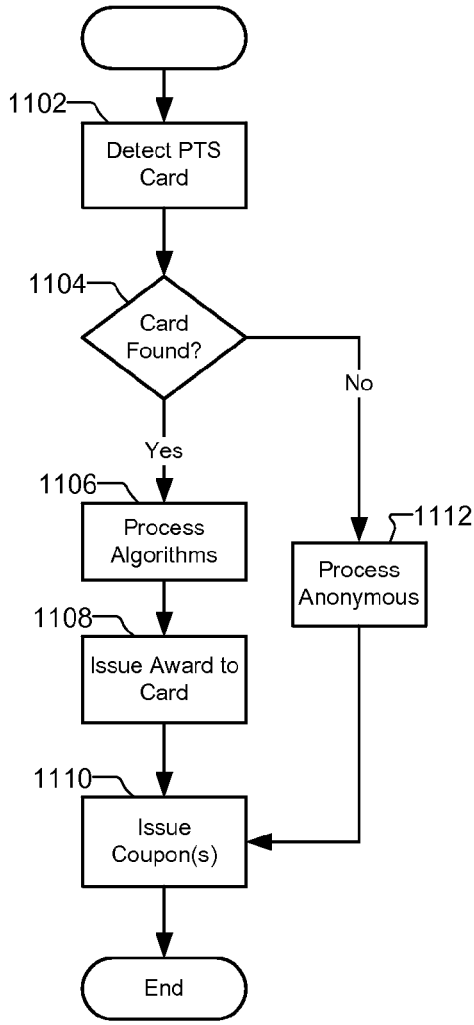
FIG. 11 is a flow chart diagram of a process for issuing awards and coupons in accordance with an exemplary embodiment of the present invention.

FIG. 11 is a flow chart diagram of a process for issuing awards and coupons in accordance with an exemplary embodiment of the present invention.

In most gaming establishments there is little or no player tracking on the gaming table. If a player wants PTS, the player must ask a pit boss for it. The pit boss then must go somewhere else to get the award for the player. By using the secured gaming table device 100 (of FIG. 1*a*), the player simply inserts their PTS card for scanning to review and/or update their PTS awards.

Using the present invention, algorithms are used to award points. The algorithms can come from one or more host systems such as a PTS 208 (of FIG. 2) or the pit boss, among others. The algorithms compare how much was played by using voucher information from an inserted game voucher, a credit transfer, and/or a percentage to determine the award value among others.

As illustrated, the process begins with detect PTS card 1102 where a host system such as a PTS 208 (of FIG. 2) queries for a player tracking card inserted in the secured gaming table device 100 (of FIG. 1*a*). If the card is found 1104, the process continues with process algorithms 1106 where algorithms determine the award to issue to a PTS card. Additionally algorithms send and receive data from a Promotional Couponing System 212 (of FIG. 2) to issue one or more promotional coupons.

Once the algorithms are processed 1106, the secured gaming table device 100 (of FIG. 1*a*) issues the award to the card 1108. The secured gaming table device, based on signaling from a host system such as a Promotional Couponing System 212 (of FIG. 2), then issues one or more promotional coupons 1110 to the player and the process ends.

If a card was not found 1104, the process continues with process anonymous 1112 where, for instance, the player is given an incentive to join a player tracking club. Then, the secured gaming table device 100 (of FIG. 1*a*), based on signaling from a host system such as a Promotional Couponing System 212 (of FIG. 2), then issues one or more promotional coupons 1110 to the player and the process ends.

Figure 12A:
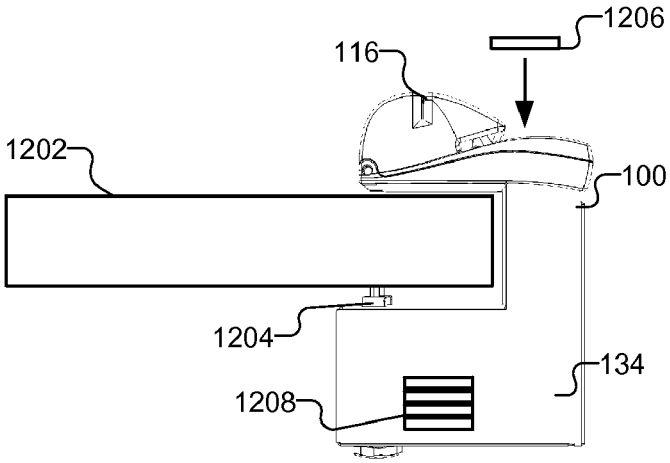
FIG. 12*a* is a side view of a secured gaming table device in accordance with an exemplary embodiment of the present invention.

FIG. 12*a* is a side view of a secured gaming table device in accordance with an exemplary embodiment of the present invention.

The secured gaming table device 100 includes any or all components as disclosed throughout this specification. As illustrated, a secured gaming table device connects to a gaming table 1202 where the main body of the secured gaming table device is concealed on the side or underneath the gaming table. In another embodiment, the secured gaming table device is positioned partially or completely below the gaming table with the entry/exit point for issuing and/or receiving game vouchers, promotional coupons, and/or other media positioned through an aperture on the gaming table.

The secured gaming table device 100 is removably, mechanically, and slidably mounted 1204 to allow access to the device. The secured gaming table device slides out for servicing and slides in for use. In another embodiment, the secured gaming table device is removably and mechanically mounted to allow access to the device such as swinging down for servicing.

In another embodiment, a game voucher, promotional coupon, PTS card or other media 1206, such as rewritable cards is inserted or placed horizontally on the secured gaming table device 100, thereby signaling a cash-in signal. The secured gaming table device, after accepting the game voucher, promotional coupon, PTS card, or other media, then moves the game voucher, promotional coupon, PTS card, or other media to a storage area 134 of the secured gaming table device where it is stored in a horizontal fashion 1208.

In another embodiment, a cash-out signal is received by the secured gaming table device 100 after which the secured gaming table device locates and pulls media, such as a rewritable card, from a storage area 134 of the secured gaming table device. The secured gaming table device then issues the media 1206 such as a rewritable card.

Additionally, the secured gaming table device 100 pulls media from a storage device 134 to issue a game voucher, promotional coupon, or other media.

Additionally, the rewritable card or other media 1206 is thermally printed and/or magnetically encoded with additional data and information, and/or thermally and/or magnetically erased at any time by the card reader/writer 116 of the secured gaming table device 100.

Figure 12B:
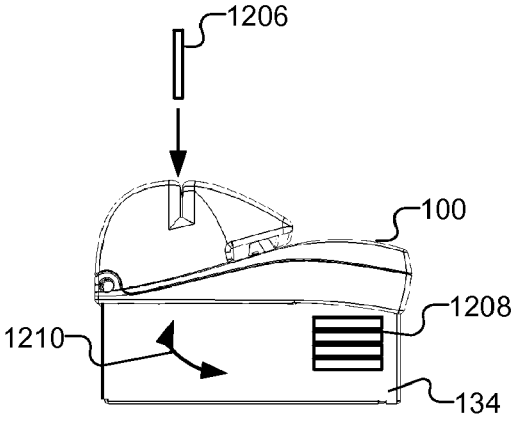
FIG. 12*b* is a side view of a secured gaming table device with means to rotate media in accordance with an exemplary embodiment of the present invention.

FIG. 12*b* is a side view of a secured gaming table device with means to rotate media in accordance with an exemplary embodiment of the present invention.

The secured gaming table device 100 includes any or all components as disclosed throughout this specification. In this embodiment, the secured gaming table device rotates media 1206, such as a rewritable card, thereby providing a low profile and more desirable physical profile of the secured gaming table device. For example, media is rotated 90 degrees 1210.

In one embodiment, the media 1206, such as a game voucher, promotional coupon, other media, such as rewritable cards is inserted or placed vertically on the secured gaming table device 100, thereby signaling a cash-in signal. The secured gaming table device and means thereof, after accepting the game voucher, promotional coupon, or other media then rotates 1210 the game voucher, promotional coupon, or other media. This rotation can occur at a point within the secured gaming table device prior to the game voucher, promotional coupon, or other media being placed in a storage area 134 of the secured gaming table device 100 in a horizontal fashion 1208.

Additionally, when a cash-out signal is received by the secured gaming table device 100, the secured gaming table device locates and pulls media 1206, such as a rewritable card, from a storage area 134 of the secured gaming table device. The secured gaming table device then rotates 1210 the game voucher, promotional coupon, or other media, such as a rewritable card to fit through the low profile area after which the device issues the media.

In another embodiment, the secured gaming table device 100 when accepting a game voucher and/or promotional coupon of one media type such as paper guides this media to the storage area 134 instead of rotating the media.

Figure 12C:
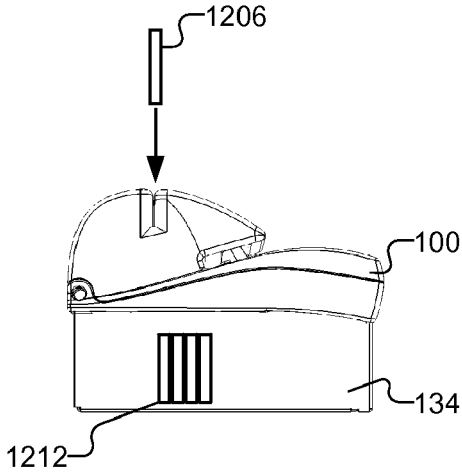
FIG. 12*c* is a side view of a secured gaming table device with means to process vertical media in accordance with an exemplary embodiment of the present invention.

FIG. 12*c* is a side view of a secured gaming table device with means to process vertical media in accordance with an exemplary embodiment of the present invention.

The secured gaming table device 100 includes any or all components as disclosed throughout this specification. In this embodiment, the secured gaming table device connects to a gaming table 102 (of FIG. 1*a*) in a fashion which permits game vouchers, promotional coupons, and other media 1206, such as rewritable cards to be inserted and issued vertically as well as stored vertically 1212 in a storage area 134 of the secured gaming table device.

Figure 12D:
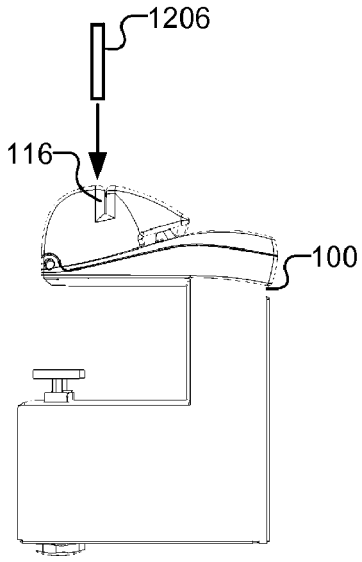
FIG. 12*d* is a side view of a secured gaming table device having magnetic stripe reading/writing means in accordance with an exemplary embodiment of the present invention.

FIG. 12*d* is a side view of a secured gaming table device having magnetic stripe reading/writing means in accordance with an exemplary embodiment of the present invention.

The secured gaming table device 100 includes any or all components as disclosed throughout this specification. The card reader/writer 116 reads the magnetic stripe and writes data to the magnetic stripe of media 1206 such as a rewritable card, credit card, debit card, and/or smart card, among others.

In one embodiment, a card 1206 is swiped through the card reader/writer 116. In another, the card is fed to the card reader/writer.

In another embodiment, reading and/or writing by the card reader/writer 116 is accomplished by moving the card reader/writer over a card which is stationary.

In another embodiment, the movement of the card reader/writer 116 is manual. In another, the movement is motorized. In another embodiment, the card reader/writer is positioned above or below a card.

Figure 12E:
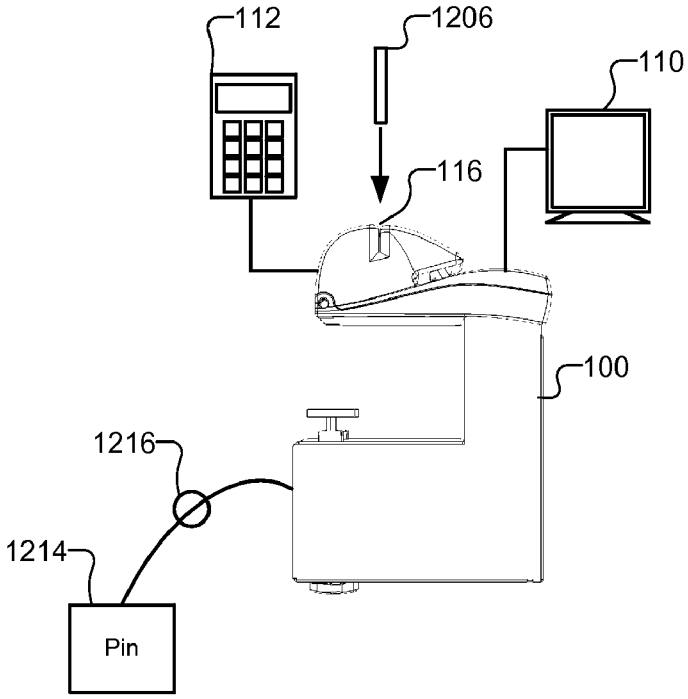
FIG. 12*e* is a side view of a secured gaming table device having magnetic stripe reading/writing means and being connected to a PIN device, keypad, and display in accordance with an exemplary embodiment of the present invention; and APPENDIX A is a list of definitions of terms as used herein.

FIG. 12*e* is a side view of a secured gaming table device having magnetic stripe reading/writing means and being connected to a PIN device, keypad, and display in accordance with an exemplary embodiment of the present invention. The secured gaming table device includes any or all components and operations as disclosed throughout this specification. Any or all components are internal or external to the secured gaming table device.

The secured gaming table device 100 includes a card reader/writer 116, keypad 112 and/or user interface 110 such as previously disclosed in FIG. 1*a* and FIG. 1*b*.

The secured gaming table device 100 also connects to a personal identification number (PIN) device 1214 for security of access. The PIN device is a keypad that is mounted or on a tether 1216 of the type normally used for debit and credit card transactions. The PIN device also can include a bio metric security feature to control the operation of or access to the secured gaming table device.

In this embodiment, reading and writing magnetic stripe data is accomplished by moving or swiping a card 1206 through or over a fixed or stationary card reader/writer 116, the operation manual or motorized.

In another embodiment, the PIN device 1214 and keypad 112 of the secured gaming table device 100 are one component.

Although the invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supportable by this application and the claims' equivalents rather than the foregoing description.

What is claimed is:

1. A secured gaming table device, comprising:

a housing having an interior portion and an exterior surface;

a printer located in the interior portion of the housing and configured to print a game voucher and present the game voucher to a player;

a barcode reader located in the interior portion of the housing and configured to read a barcode of the game voucher;

a bill validator located in the interior portion of the housing and configured to read currency received from a player;

a user interface located on the exterior surface of the housing and visible to a dealer and the player;

a keypad interface located on the exterior surface of the housing and accessible to the dealer and the player;

a card reader/writer located in the interior portion of the housing and configured to read cards;

an RFID reading device located in the interior portion of the housing and configured to read RFID gaming chips;

an entry point visible from the exterior surface of the housing and configured to accept RFID gaming chips and to provide signaling when RFID gaming chips are pushed into the entry point; and a controller located in the interior portion of the housing and coupled to the printer, barcode reader, bill validator, user interface, keypad, card reader/writer, RFID reading device, and entry point, wherein the controller is configured to provide a connection to one or more host systems.

2. The secured gaming table device of claim 1, wherein the printer is further configured to print a promotional coupon and present the promotional coupon to the player.

3. The secured gaming table device of claim 1, wherein the printer is further configured to print a transaction receipt and present the transaction receipt to the player.

4. The secured gaming table device of claim 1, wherein the barcode reader is further configured to read a promotional coupon.

5. The secured gaming table device of claim 1, wherein the card reader/writer is further configured to read and write rewritable cards.

6. The secured gaming table device of claim 1, wherein the card reader/writer is further configured to read credit cards.

7. The secured gaming table device of claim 1, wherein the card reader/writer is further configured to read debit cards.

8. The secured gaming table device of claim 1, wherein the card reader/writer is further configured to read and write smart cards.

9. The secured gaming table device of claim 1, wherein the one or more host systems include an accounting system.

10. The secured gaming table device of claim 1, wherein the one or more host systems include a Ticket In Ticket Out (TITO).

11. The secured gaming table device of claim 1, wherein the one or more host systems include a Slot Machine Interface Board (SMIB).

12. The secured gaming table device of claim 1, wherein the one or more host systems include a Player Tracking System (PTS).

13. The secured gaming table device of claim 1, wherein the one or more host systems include a gaming chip issuance and tracking system.

14. The secured gaming table device of claim 1, wherein the one or more host systems include a promotional couponing system.

15. The secured gaming table device of claim 1, wherein the one or more host systems include a cash-out vouchering system.

16. The secured gaming table device of claim 1, wherein the one or more host systems include a point-of-sale system (POS).

17. The secured gaming table device of claim 1, wherein the one or more host systems include a gaming table system.

18. The secured gaming table device of claim 1, wherein the entry point provides signaling in the form of flashing lights.

* * * * *